US011131127B2

(12) United States Patent
Hunt et al.

(10) Patent No.: US 11,131,127 B2
(45) Date of Patent: Sep. 28, 2021

(54) MOTOR VEHICLE DOOR LATCH

(71) Applicant: Kiekert AG, Heiligenhaus (DE)

(72) Inventors: Robert J. Hunt, Davisburg, MI (US); Robert S. Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 874 days.

(21) Appl. No.: 15/846,617

(22) Filed: Dec. 19, 2017

(65) Prior Publication Data

US 2018/0171680 A1 Jun. 21, 2018

Related U.S. Application Data

(60) Provisional application No. 62/436,111, filed on Dec. 19, 2016.

(51) Int. Cl.

| | |
|---|---|
| ***E05B 81/20*** | (2014.01) |
| ***E05B 81/28*** | (2014.01) |
| ***E05B 81/16*** | (2014.01) |
| ***E05B 81/40*** | (2014.01) |
| ***E05B 81/06*** | (2014.01) |

(52) U.S. Cl.

CPC ..... *E05B 81/20* (2013.01); *E05B 81/16* (2013.01); *E05B 81/28* (2013.01); *E05B 81/06* (2013.01); *E05B 81/40* (2013.01); *Y10S 292/23* (2013.01); *Y10T 292/108* (2015.04); *Y10T 292/1043* (2015.04); *Y10T 292/1047* (2015.04); *Y10T 292/1082* (2015.04); *Y10T 292/1092* (2015.04)

(58) Field of Classification Search

CPC ..... E05B 81/74; E05B 81/66; E05B 81/68; E05B 81/72; E05B 81/40; E05B 81/06; E05B 81/16; E05B 81/20; E05B 81/28; Y10T 292/108; Y10T 292/1082; Y10T 292/1092; Y10T 292/1047; Y10T 292/1043

See application file for complete search history.

(56) References Cited

U.S. PATENT DOCUMENTS 4,135,377 A * 1/1979 Kleefeldt ..... E05B 81/25 292/144
5,273,324 A * 12/1993 Kobayashi ..... E05B 81/20 292/201
5,713,613 A * 2/1998 Honma ..... E05B 77/48 292/201

(Continued)

FOREIGN PATENT DOCUMENTS

EP 1 319 780 B1 6/2003

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

A motor vehicle door latch which is equipped with a locking bolt and a locking mechanism interacting with the locking bolt, including a catch and a pawl. The motor vehicle door latch possesses a stop lever pivotably located on the control lever, which interacts with a protrusion on the catch beyond a main ratchet position and a pre-ratchet position, whereby the protrusion corresponds to a third ratchet position with an increased distance of the locking bolt in respect of the main ratchet and pre-ratchet position compared to a catch axis. The stop lever impinges a triggering lever lifting the pawl from the catch in order to open the locking mechanism.

18 Claims, 2 Drawing Sheets

(56) References Cited

U.S. PATENT DOCUMENTS 5,868,444 A * 2/1999 Brackmann ..... E05B 81/20 292/196
6,435,575 B1 * 8/2002 Pajak ..... E05B 81/14 292/201
6,997,488 B2 * 2/2006 Kurten ..... E05B 81/14 292/201
9,541,156 B2 * 1/2017 Blumenthal ..... H02K 7/1166
2003/0080569 A1 * 5/2003 Raymond ..... E05B 81/66 292/201
2005/0082842 A1 * 4/2005 Warmke ..... E05B 77/28 292/216
2005/0184534 A1 * 8/2005 Oberheide ..... E05B 81/20 292/201
2007/0138802 A1 * 6/2007 Stasko ..... E05B 81/14 292/201
2007/0220934 A1 * 9/2007 Chevalier ..... E05B 77/28 70/237
2010/0194120 A1 * 8/2010 Kaiser ..... E05B 81/20 292/198
2011/0012380 A1 * 1/2011 Bendel ..... E05B 81/20 292/341.16
2011/0074168 A1 * 3/2011 Bendel ..... E05B 81/46 292/144
2016/0053517 A1 * 2/2016 Tomaszewski ..... E05B 81/72 200/573
2016/0245000 A1 * 8/2016 Ottino ..... E05B 85/26
2017/0298661 A1 * 10/2017 Byun ..... E05B 81/06
2018/0016822 A1 * 1/2018 Sturm ..... E05B 81/25
2018/0058116 A1 * 3/2018 Erices ..... E05B 79/20
2018/0171678 A1 * 6/2018 Pettengill ..... E05B 81/15
2018/0171681 A1 * 6/2018 Hunt ..... E05B 81/14
2018/0347240 A1 * 12/2018 Jeong ..... E05B 81/36
2018/0355644 A1 * 12/2018 Jeong ..... E05B 83/18
2019/0078361 A1 * 3/2019 Worden ..... E05F 15/614
2019/0226247 A1 * 7/2019 Johann ..... E05B 81/16
2019/0301212 A1 * 10/2019 Digel ..... E05B 81/36
2019/0338568 A1 * 11/2019 Klein ..... E05B 79/20
2019/0351952 A1 * 11/2019 Hunt ..... E05B 81/14

* cited by examiner

MOTOR VEHICLE DOOR LATCH

This application claims priority to U.S. Provisional Patent Application No. 62/436,111 filed Dec. 19, 2016, which is hereby incorporated herein by reference in its entirety.

The invention relates to a motor vehicle door latch, with a locking bolt and a locking mechanism interacting with the locking bolt fundamentally comprising a catch and pawl, and with a stop lever pivotably located on a control lever which interacts with a protrusion on the catch beyond a main ratchet and pre-ratchet position, whereby the protrusion corresponds to a third ratchet position with an increased distance of the locking bolt compared to a catch axis in respect of the main ratchet and pre-ratchet position.

The third ratchet position beyond the main ratchet and pre-ratchet position of the locking mechanism generally corresponds to the locking bolt entering the locking mechanism being able to be trapped "before" reaching the pre-ratchet position. Thus, it is possible in theory to still be able to close the pertaining motor vehicle door, for example, even with a relatively large door gap. Normally, such a closure process is only commenced when the locking mechanism has assumed its pre-ratchet position. Due to the third position upstream from the main ratchet and the pre-ratchet position such a closure process can now be started, even with an increased distance of the locking bolt compared to the catch axis and in respect of the main ratchet and pre-ratchet position. This has proven itself in principle.

BACKGROUND

The class-specific state of the art according to EP 1 319 780 B1 is a motorized closure device which demonstrates a mechanically adjustable coupling carrier. A coupling lever with a coupling nose is adjustably arranged on the coupling carrier. The coupling nose is stressed on the catch by a spring element in the direction of a coupling ratchet and adjusted away from the coupling ratchet via a loosening device.

During the motorized adjustment of the coupling carrier to transfer the catch into its latching position, the coupling nose of the coupling lever engages in a force-fitting manner into the coupling ratchet of the catch. Thus, the motorized closure of the latch should be able to be automatically interrupted if a body part or an object is clamped between the motor vehicle door and a frame.

The open position and lifting of the pawl from the main ratchet of the catch is achieved by reversing the rotational direction of the motorized drive. Thus, the catch coupled with the coupling carrier via the coupling lever is adjusted into its open position in a motorized manner. It is not free from defects.

Because the open position of the catch ultimately depends on the known motor drive in the EP 1 319 780 B1 not only executing the described reversal of rotational direction, but also fully completing the necessary opening path. Hereby, there can be problems where the motor drive demonstrates wear, can no longer function perfectly due to age or also where the adjustment or opening path is not or is no longer fully completed due to temperature effects. This applies all the more because the known motor vehicle door latch demonstrates a multitude of functional elements which are exposed to age-related bearing play, corrosion, etc. This is where the invention is used.

SUMMARY

The invention is based on the technical problem of further developing such a motor vehicle door latch in such a way that a functional operation is guaranteed with simultaneously simple construction.

In order to solve this technical problem, a class-specific motor vehicle door latch within the scope of the invention is characterized in that the stop lever impinges a triggering lever lifting the pawl from the catch for opening of the locking mechanism. Additionally and advantageously, it is proceeded in such a way that the stop lever interacts with a contour on the triggering lever in such a way to open the locking mechanism that it (the stop lever) is lifted from its mesh with the protrusion on the catch.

Within the scope of the invention, initially a motorized opening process of the locking mechanism or catch does not explicitly occur. Instead, the locking mechanism is opened in such a way that the stop lever initially impinges the triggering lever. As the triggering lever typically takes the pawl along and lifts it from the catch when impinged, the impingement of the triggering lever with the aid of the stop lever ensures that the locking mechanism is opened or the pawl is released around its mesh with a main ratchet or a pre-ratchet on the catch.

In order that not only the pawl is lifted from its mesh with the catch in this process, but also the stop lever from the protrusion on the catch, the configuration is advantageously such that the stop lever interacts not only with the triggering lever as such, but in detail with a contour on the triggering lever. This interaction takes place in such a way that the stop lever not only strikes the relevant contour on the triggering lever and thus impinges the triggering lever and with it the pawl. Instead, when driving the stop lever against the contour on the triggering lever the stop lever which is pivotably located on the control lever is pivoted. In detail, the stop lever is pivoted by the interaction with the contour on the triggering lever in such a way that it is lifted from its mesh with the protrusion on the catch.

Generally, both previously described processes take place simultaneously or almost simultaneously. i.e. the stop lever travels on the one hand against the contour on the triggering lever and hereby lifts the triggering lever and also the pawl from the catch. At the same time, the journey of the stop lever against the contour on the triggering lever ensures that the stop lever is pivoted on the other hand. The stop lever is pivoted in this process in such a way that it is unable to mesh with the protrusion on the catch. As a consequence hereof, the catch can pivot into its open position in a spring-assisted manner subsequently in contrast to the state of the art without motorized assistance. Instead, a spring impinging the catch in the opening direction ensures pivoting up of the catch as usual.

Consequently, the catch is customarily opened mechanically or by spring force by the pawl on the one hand and the stop lever on the other hand being lifted from their mesh with the catch. Subsequently, the catch can pivot freely and in a spring-assisted manner. This process is connected to any displacements or motor movements and can consequently be implemented especially easily and functionally. Furthermore, neither age-related functional defects nor those due to temperature effects are anticipated.

The control lever with the stop lever pivotably located thereon can be manually driven in principle and thus transferred into the third ratchet position. Additionally, the control lever and the stop lever pivotably located thereon can be manually lifted from the protrusion on the catch. However, the control lever is generally connected to a drive. The drive is advantageously a closure drive. Furthermore, the drive is usually formed as a spindle drive.

In this case, the drive has a motor or electromotor which causes a spindle on the output side to rotate directly or via an interposed gear unit. As a consequence hereof, a spindle nut located on the spindle can be moved linearly backwards and forwards. The drive is usually connected to the control lever via the relevant and movable spindle nut.

An especially compact and functional configuration is characterized in that the control lever is located coaxially compared to the catch. Hereby, the invention is based on the insight that the catch and the pawl are usually accommodated in a metallic latch case. To this end, a bolt is respectively anchored in the relevant latch case, with the help of which the catch or pawl is pivotably located in the relevant latch case. The bolt or axis bolt provided for here to the pivotable location of the catch is now advantageously used simultaneously as an axis bolt for the control lever. Consequently, the coaxial location is achieved compared to the catch.

A further bolt is fixed in the latch case at a distance from the bolt for the location of the catch, with the help of which the pawl is also pivotably accommodated in the latch case. The triggering lever can be located coaxially to the pawl on the common bolt or axis bolt. Thus, impingement of the triggering lever simultaneously ensures that the pawl is taken along and lifted from its mesh with the catch hereby.

The stop lever pivotably located on the control lever generally has a spring pre-tensioning it in the direction of the protrusion on the catch. As soon as the stop lever travels against the contour on the triggering lever to open the locking mechanism, the stop lever must consequently be lifted from the protrusion on the catch against spring force.

In order to execute and implement this in detail, the stop lever is generally designed as a two-arm lever with its axis or rotational axis provided for on the control lever. Due to the form of the stop lever as a two-arm lever, the stop lever typically has a protruding lever arm and a triggering lever arm which are arranged on both sides of its rotational axis. The protruding lever arm interacts with the protrusion on the catch. In contrast, the triggering lever arm of the stop lever is set up and configured for interaction with the triggering lever or the contour on the triggering lever.

The triggering lever arm is generally hook-shaped. Thus, the triggering lever arm can interact especially advantageously with the contour on the triggering lever which is regularly configured as a starting angle for this purpose. As soon as the control lever and also the stop lever pivotably located thereon travels against the triggering lever or the contour on the triggering lever, the hook shape of the triggering lever arm striking the running surface ensures that not only the triggering lever and the pawl are lifted from the catch, but the stop lever is simultaneously pivoted around its axis. The pivoting is such that the stop lever with its protruding lever arm is lifted from the protrusion on the rotational axis. As a consequence hereof, the catch overall is released from the pawl and the stop lever and can be transferred into the open position to open the locking mechanism as desired and in a spring-assisted manner. These are beneficial advantages.

BRIEF DESCRIPTION OF THE DRAWINGS

Hereinafter, the invention is explained in further detail on the basis of a sketch which only depicts an execution example. It shows.

DETAILED DESCRIPTION

Figure 1:
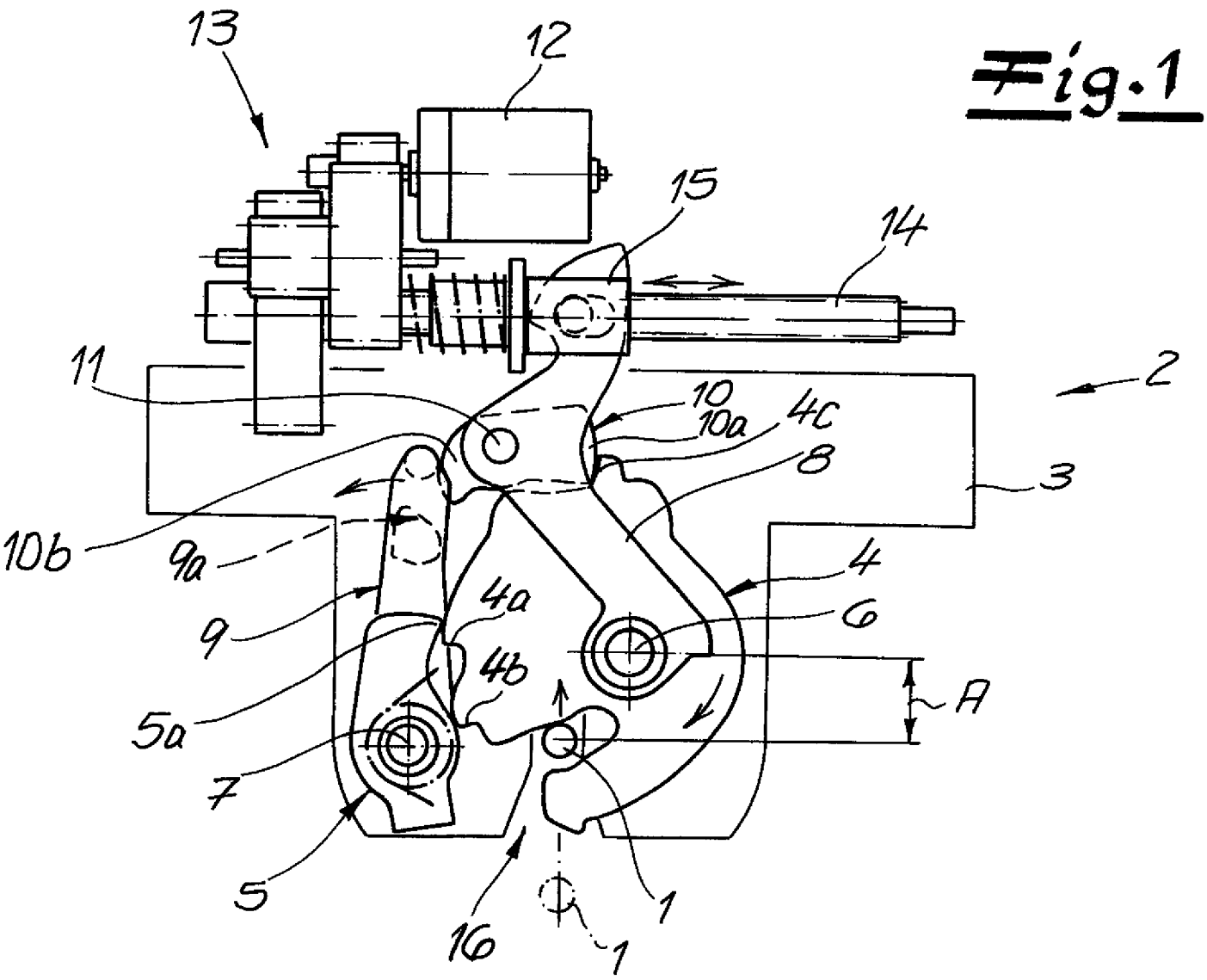
FIG. 1 The motor vehicle door latch according to the invention at the start of a depicted closure process and FIG. 2 The motor vehicle door latch during an opening process.

In the figures a motor vehicle door latch is depicted which, as usual, is equipped with a locking bolt 1 only depicted in FIG. 1 and a motor vehicle door latch 2. In the example, the motor vehicle door latch 2 is connected in or on a non-illustrated motor vehicle door. To this end, the motor vehicle door latch 2 possesses a metallic latch case 3. A locking mechanism 4, 5 consisting of a catch 4 and an interacting pawl 5 is pivotably located in the metallic latch case 3.

The catch 4 is pivotably located on a bolt 6 in the latch case 3 which simultaneously defines a rotational axis 6 for the catch 4. In a comparable manner, the pawl 5 possesses a further bolt 7 with the help of which the pawl 5 is also pivotably located compared to the latch case 3. Consequently, the bolt 7 defines a rotational axis 7 for the pawl 5.

On the basis of the illustration in FIG. 1, it is recognized that an additional control lever 8 is located coaxially compared to the catch 4 together with it in the latch case 3. i.e. the control lever 8 and the rotational axis 4 possess a common rotational axis 6.

Furthermore, another triggering lever 9 is provided for which is located coaxially compared to the pawl 5. i.e. the pawl 5 and the triggering lever 9 are respectively pivotably located with recourse to the common rotational axis 7 in the latch case 3. Thus, the triggering lever 9 interacts with the pawl 5 in the usual manner in such a way that an anti-clockwise movement of the triggering lever 9 around its rotational axis 7 illustrated in FIG. 1 corresponds to the pawl 5 located coaxially being taken along. As a consequence hereof, the pawl 5 is lifted from a main ratchet 4*b* or a pre-ratchet 4*a* which correspond to respective recesses 4*a*, 4*b* in the catch 4.

A stop lever 10 pivotably located on the control lever 8 also belongs to the fundamental structure. The stop lever 10 is designed as a two-arm lever in the execution example and possesses a rotational axis 11 with the help of which the stop lever 10 is located on the control lever 8. Due to the design of the stop lever 10 as a two-arm lever, the stop lever 10 possesses a protruding lever arm 10*a* and a triggering lever arm 10*b* which are oriented on both sides of its rotational axis 11.

In the figures, a contour 9*a* on the triggering lever 9 is recognized which interacts with the stop lever 10 or the triggering lever arm 10*b* of the stop lever 10, as explained in further detail hereafter. Furthermore, a drive 12, 13, 14, 15 for the control lever 8 is provided.

The drive 12, 13, 14, 15 comprises an electromotor 12 and a downstream optional gear unit 13 and a spindle 14 driven via the electromotor 12 and the gear unit 13. Furthermore, a spindle nut 15 is apparent by its linearly movable rotation on the spindle 14. The linear movement of the spindle nut 15 is depicted by a double arrow in FIG. 1. Furthermore, the spindle nut 15 is connected to the control lever 8. Consequently, the depicted linear backwards and forwards movement of the spindle nut 15 corresponds to the control lever 8 being pivoted around its common rotational axis 6 with the catch 4.

It operates as follows. The stop lever 10 pivotably located on the control lever 8 interacts with a protrusion 4*c* on the catch 4 beyond the main ratchet position and the pre-ratchet position. The main ratchet position corresponds to the pawl 5 engaging into the recess 4*b* or into the main ratchet 4*b* with its front nose. On the contrary, the pre-ratchet position corresponds to the nose 5*a* on the pawl 5 interacting with the pre-ratchet 4*a* or the recess 4*a*.

If the locking bolt 1 now enters an infeed section 16 of the latch case or latch plate 3 to close the locking mechanism 4, 5 starting from the dot-dashed position in FIG. 1 and reaches the position depicted as a continuous line, thus the stop lever 10 pivotably located on the control lever 8 can interact with the protrusion 4*c* on the catch 4. This occurs beyond the already described main ratchet position and pre-ratchet position, in such a way that the locking bolt 1 in this case demonstrates an increased distance A compared to the catch axis 6, than in the case in which the locking mechanism 4, 5 assumes its main ratchet position or pre-ratchet position. Thus, a third ratchet position is executed in addition to the previously described main ratchet position and pre-ratchet position.

The main ratchet position and pre-ratchet position are then adjusted starting from the illustration in FIG. 1 when the catch 4 is further closed. A clockwise direction movement of the catch 4 indicated in FIG. 1 corresponds to this. In order to initiate the closure movement of the catch 4, the drive 12, 13, 14, 15 is provided for which impinges the control lever 8. In fact, the relevant control lever 8 is connected to the drive 12, 13, 14, 15. In the execution example, the spindle nut 15 engages on an abaxial end into the control lever 8 or interacts with the control lever 8.

As soon as the control lever 8 is moved to the right in the indicated arrow direction starting from the illustration according to FIG. 1, this process corresponds to the catch 4 being pivoted around its axis 6 in a clockwise direction. As a consequence hereof, the locking bolt 1 is moved in the indicated arrow direction and the locking mechanism 4, 5 closed overall. This succeeds due to the attained third ratchet position with the door leaf further open compared to the pre-ratchet position or the main ratchet position, i.e. "before".

Following the illustration according to FIG. 1, this corresponds to the nose 5*a* on the pawl 5 initially engaging into the pre-ratchet 4*a* and then the main ratchet 4*b*. As a consequence hereof, the catch 4 is located in the main ratchet position at the end of the closure process.

Figure 2:
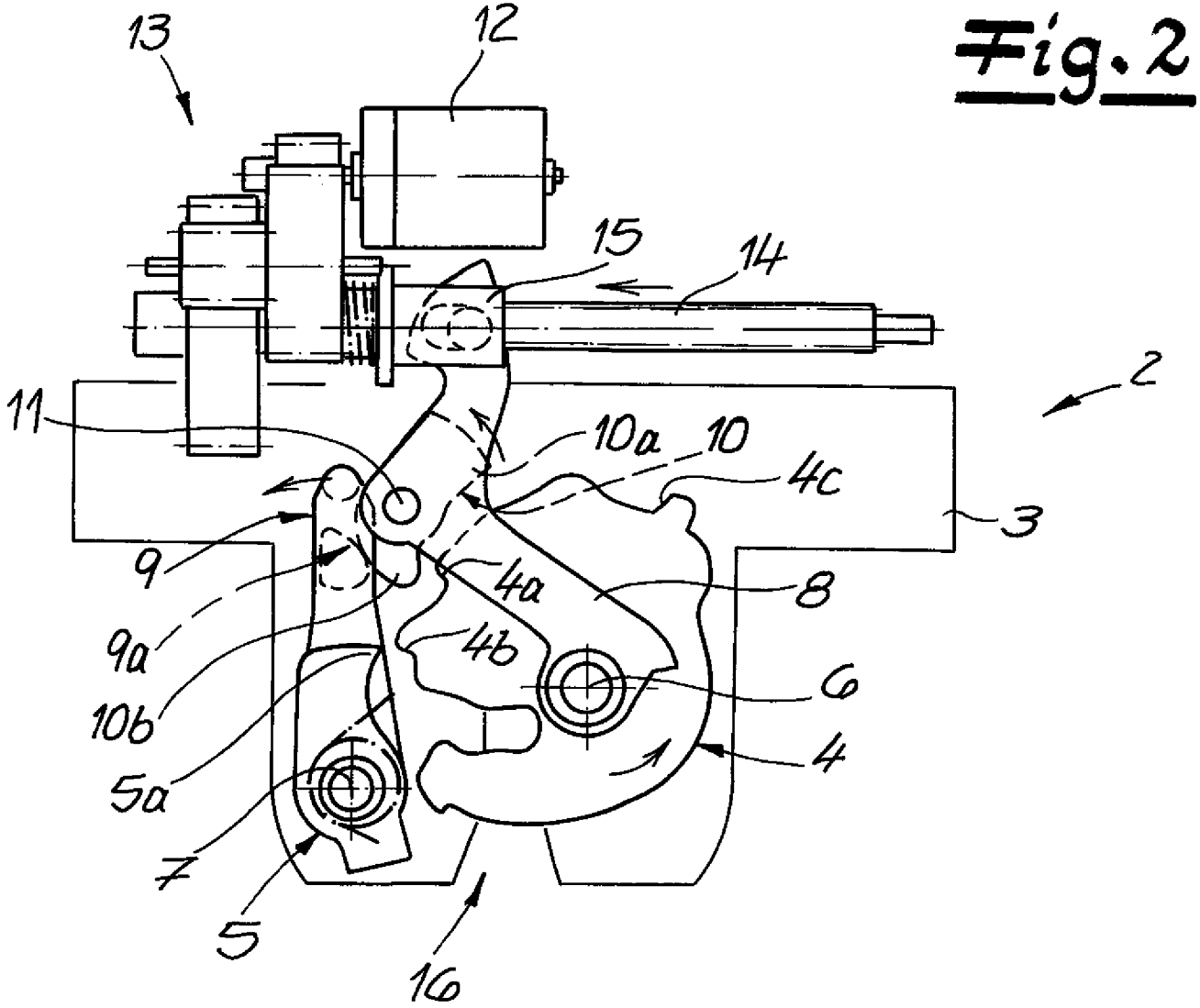

In order to now open the locking mechanism 4, 5 starting from this main ratchet position it is provided for according to the invention that the stop lever 10 pivotably located on the control lever 8 impinges the triggering lever 9. To this end, the spindle nut 15 is moved in the opposite direction with the aid of the drive 12, 13, 14, 15 compared to the closure process according to FIG. 1, as apparent from FIG. 2 and relevant arrows. The impingement of the triggering lever 9 lifts the pawl 5 from the catch 4. In fact, the impingement of the triggering lever 9 with the aid of the stop lever 10 corresponds to the triggering lever 9 executing the anti-clockwise direction movement around its axis 7 already illustrated in FIG. 1. As a consequence hereof, the nose 5*a* of the pawl 5 leaves the main ratchet 4*b* and the pawl 5 is lifted from the catch 4 overall, as illustrated in FIG. 2.

The stop lever 10 interacts with the contour 9*a* on the triggering lever 9 in such a way to open the locking mechanism 4, 5 that the stop lever 10 is lifted from its mesh with the protrusion 4*c* on the catch 4. In fact, the stop lever 10 is initially pre-tensioned with the aid of a not explicitly illustrated spring in the direction of the relevant protrusion 4*c* on the catch 4. In order to remove the stop lever 10 from the protrusion 4*c*, the force of this spring must be overcome.

In detail, the invention attains this by the triggering lever arm 10*b* of the stop lever 10 being hook-shaped overall. Furthermore, the triggering lever arm 10*b* interacts with the contour 9*a* on the triggering lever 9. For this purpose, the contour 9*a* is designed as a starting angle 9*a* for the hook-shaped triggering arm 10*b*. On the basis of the illustration in FIG. 2, it is recognized that the stop lever 10 in the execution example is pivoted around its axis 11 in an anti-clockwise direction depicted by an arrow by the initiation of the hook-shaped triggering arm 10*b* of the stop lever 10 on the starting angle 9*a*. As a consequence hereof, the protrusion lever arm 10*a* is pivoted away from the protrusion 4*c* of the catch 4. Consequently, the catch 4 is released both from the stop lever 10 and the pawl 5 overall. Thus, the catch 4 can subsequently pivot in a spring-assisted manner around its axis 6 in the anti-clockwise direction indicated in FIG. 2. The locking mechanism 4, 5 is now opened and is released from the previously trapped locking bolt 1.

What is claimed is:

1. A motor vehicle door latch, comprising:

a locking bolt, and a locking mechanism interacting with the locking bolt, the locking mechanism including a catch and a pawl, and a stop lever pivotably located on a control lever which interacts with a protrusion on the catch beyond a main ratchet and pre-ratchet position, whereby the protrusion corresponds to a third ratchet position with an increased distance of the locking bolt vis-à-vis the main ratchet and pre-ratchet position compared to a catch axis, and wherein in order to open the locking mechanism the stop lever is disposed to impinge a triggering lever lifting the pawl from the catch, wherein the control lever is located coaxially in relation to the catch.

2. A motor vehicle door latch according to claim 1, wherein the stop lever is disposed to interact with a contour on the triggering lever in such a way to open the locking mechanism that it is lifted from its mesh with the protrusion on the catch.

3. A motor vehicle door latch according to claim 1, wherein the control lever is connected to a closure drive.

4. A motor vehicle door latch according to claim 3, wherein the closure drive is formed as a spindle drive.

5. A motor vehicle door latch according to claim 4, wherein the closure drive is connected with the control lever via a movable spindle nut.

6. A motor vehicle door latch according to claim 1, wherein the stop lever provides a spring pre-tensioning it in the direction of the protrusion on the catch.

7. A motor vehicle door latch according to claim 1, wherein the stop lever is formed as a two arm lever.

8. A motor vehicle door latch according to claim 7, wherein the stop lever is equipped with a protrusion lever arm and a triggering lever arm on both sides of its rotational axis.

9. A motor vehicle door latch according to claim 8, wherein the triggering lever arm is hook-shaped and interacts with a starting angle as a contour of the triggering lever.

10. The motor vehicle door latch according to claim 1, wherein the catch has a first recess corresponding to the main ratchet position and a second recess corresponding to the pre-ratchet position, the protrusion being separate from the first recess and the second recess.

11. The motor vehicle door latch according to claim 10, wherein the third ratchet position is upstream from the main ratchet position and the pre-ratchet position relative to a direction of the catch in which the catch rotate during closure.

12. A motor vehicle door latch, comprising:

a locking bolt, and a locking mechanism interacting with the locking bolt, the locking mechanism including a catch and a pawl, and a stop lever pivotably located on a control lever which interacts with a protrusion on the catch beyond a main ratchet and pre-ratchet position, whereby the protrusion corresponds to a third ratchet position with an increased distance of the locking bolt vis-à-vis the main ratchet and pre-ratchet position compared to a catch axis, wherein in order to open the locking mechanism the stop lever is disposed to impinge a triggering lever lifting the pawl from the catch, and wherein the stop lever is formed as a two arm lever.

13. The motor vehicle door latch according to claim 12, wherein the control lever is connected to a closure drive.

14. The motor vehicle door latch according to claim 13, wherein the closure drive is formed as a spindle drive.

15. The motor vehicle door latch according to claim 14, wherein the closure drive is connected with the control lever via a movable spindle nut.

16. The motor vehicle door latch according to claim 12, wherein the stop lever provides a spring pre-tensioning it in the direction of the protrusion on the catch.

17. The motor vehicle door latch according to claim 12, wherein the catch has a first recess corresponding to the main ratchet position and a second recess corresponding to the pre-ratchet position, the protrusion being separate from the first recess and the second recess.

18. The motor vehicle door latch according to claim 17, wherein the third ratchet position is upstream from the main ratchet position and the pre-ratchet position relative to a direction of the catch in which the catch rotate during closure.

* * * * *